United States Patent [19]

Nakao et al.

[11] Patent Number: 4,458,675

[45] Date of Patent: Jul. 10, 1984

[54] ROLLER TYPE FINGER-PRESSURE APPARATUS

[75] Inventors: Shinroku Nakao, Kanagawa; Takashi Chino, Tokyo; Yuzo Abe; Katuhiro Tokutake, both of Tokyo, all of Japan

[73] Assignee: Combi Co., Ltd., Tokyo, Japan

[21] Appl. No.: 336,992

[22] Filed: Jan. 4, 1982

[30] Foreign Application Priority Data

Jan. 6, 1981 [JP] Japan ..... 56-483[U]
Jan. 8, 1981 [JP] Japan ..... 56-1060[U]

[51] Int. Cl.[3] ..... A61H 7/00
[52] U.S. Cl. ..... 128/52; 104/62
[58] Field of Search ..... 128/33, 44, 52, 56, 128/57, 60, 61, 64; 104/62, 95, 102, 107, 167, 246

[56] References Cited

U.S. PATENT DOCUMENTS 1,645,339 10/1927 Monroe ..... 128/57
2,320,261 5/1943 Buffalow ..... 128/57
3,003,497 10/1961 Nunes ..... 128/57
3,039,458 6/1962 Hill ..... 128/52
3,518,947 7/1970 Borst ..... 104/95 X
3,664,333 5/1972 Hill ..... 128/52
3,854,406 12/1974 Monne ..... 104/91
3,882,856 5/1975 Heuser et al. ..... 128/57
3,985,082 10/1976 Barac ..... 104/62 X
4,167,182 9/1979 Yamamura et al. ..... 128/56
4,228,557 10/1980 DeVivo et al. ..... 15/21 E
4,373,516 2/1983 Masuda et al. ..... 128/57

*Primary Examiner*—Richard J. Apley
*Assistant Examiner*—David J. Brown
*Attorney, Agent, or Firm*—Sughrue, Mion, Zinn, Macpeak & Seas

[57] ABSTRACT

A cover over the screw shaft in a roller-type fingerpressure apparatus prevents clogging and is also provided with flanges to help guide the moving roller frame. The vertical extension of the rollers is enhanced by having the roller shafts vertically slidable in grooves formed in plates which are themselves vertically slidable with respect to the frame.

17 Claims, 12 Drawing Figures

ROLLER TYPE FINGER-PRESSURE APPARATUS

BACKGROUND OF THE INVENTION

This invention relates to a finger-pressure apparatus, and more particularly to a roller type finger-pressure apparatus in which a finger-pressure treatment is performed by the utilization of rollers.

An object of the invention is to provide a roller type finger-pressure apparatus in which finger-pressure is applied to the human body over a wide range with rollers, and the finger-pressure effect is provided either in conformance with the curves of the human body or it is given to a freely selected part of the human body.

A roller type finger-pressure apparatus in which rollers are rotated along guide rails so that the rollers are moved vertically according to the curve of the guide rails, is known in the art. In the conventional roller type finger-pressure apparatus, supporting legs slidable on the guide rails have vertically elongated grooves, and the suporting shaft of the rollers is inserted into the elongated grooves, so that, as the rollers are moved vertically along the curve of the guide rails, the supporting shaft is also moved vertically along the elongated grooves in the supporting legs. However, the conventional apparatus is disadvantageous in that vertical movement of the supporting shaft of the rollers is limited to the length of the elongated grooves in the supporting legs. Furthermore, since it is not permissible for the supporting legs provided on the guide rails to protrude above the cover which is laid over the finger-pressure apparatus body, the stroke of vertical movement of the supporting shaft is necessarily limited.

Still further, the screw drive shaft used to advance the rollers can become clogged, or the mounting structure carrying the rollers may rock forward or backward and become jammed, either of which will disable the apparatus.

SUMMARY OF THE INVENTION

An object of the invention is to eliminate the abovedescribed drawbacks.

More particularly, an object of this invention is to provide a roller type finger-pressure apparatus in which a rotary mechanism for moving the rollers is covered with a cover to improve the safety and reliability thereof, and the rollers are smoothly moved by the utilization of the cover.

A still further object of this invention is to provide a roller-type finger-pressure apparatus in which the range of available vertical movement of the rollers is increased without increasing the size of the apparatus.

Briefly, these and other objects are achieved by a roller-type finger-pressure apparatus in which a cover piece is placed over the screw shaft which drives the rollers longitudinally, the cover also serving as a guide for preventing rocking of the roller assembly as it advances. In order to improve the range of vertical movement, the side plates in which the vertical sliding grooves are formed may themselves be vertically slidable to permit the rollers to continue to rise even after reaching the limit of the grooves.

BRIEF DESCRIPTION OF THE DRAWINGS

The accompanying drawings show preferred embodiments of this invention. In the drawings.

DETAILED DESCRIPTION OF THE INVENTION

Figure 1:
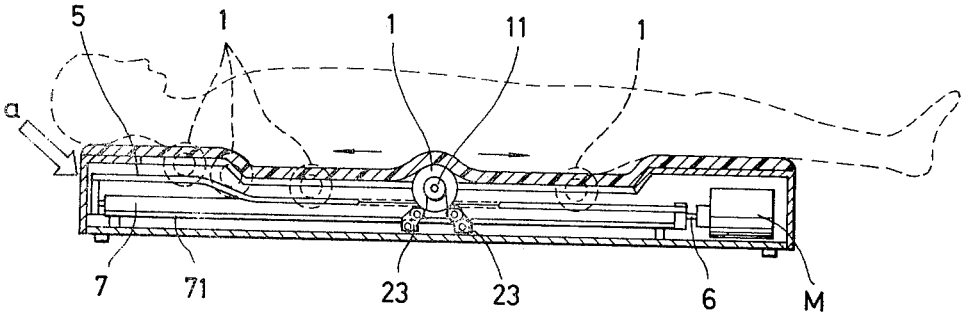
FIG. 1 is a longitudinal sectional view of a finger-pressure apparatus according to a first embodiment of the present invention.
Figure 2:
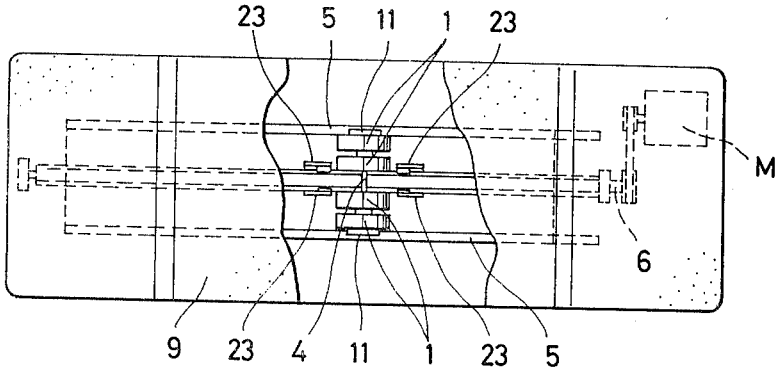
FIG. 2 is a plan view of the finger-pressure apparatus from which a part of the upper cover has been cut away.
Figure 3:
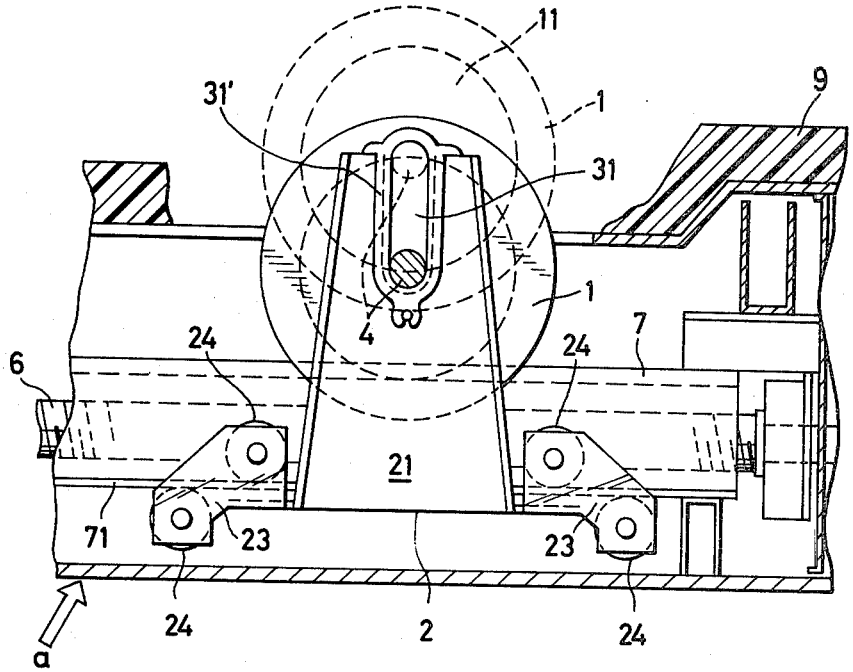
FIG. 3 is a side view of a roller moving frame of the apparatus of FIG. 1.
Figure 4:
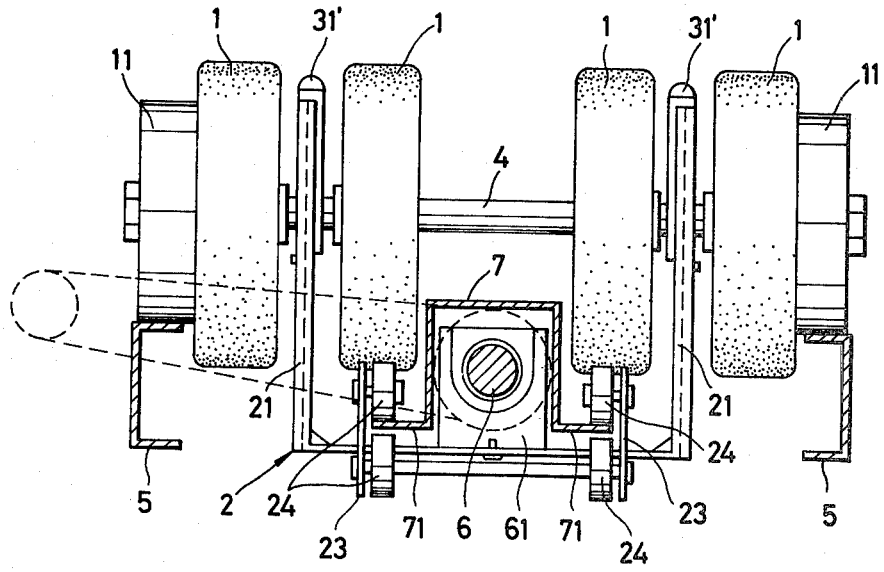
FIG. 4 is a front view of the roller moving frame shown in FIG. 3.
Figure 5:
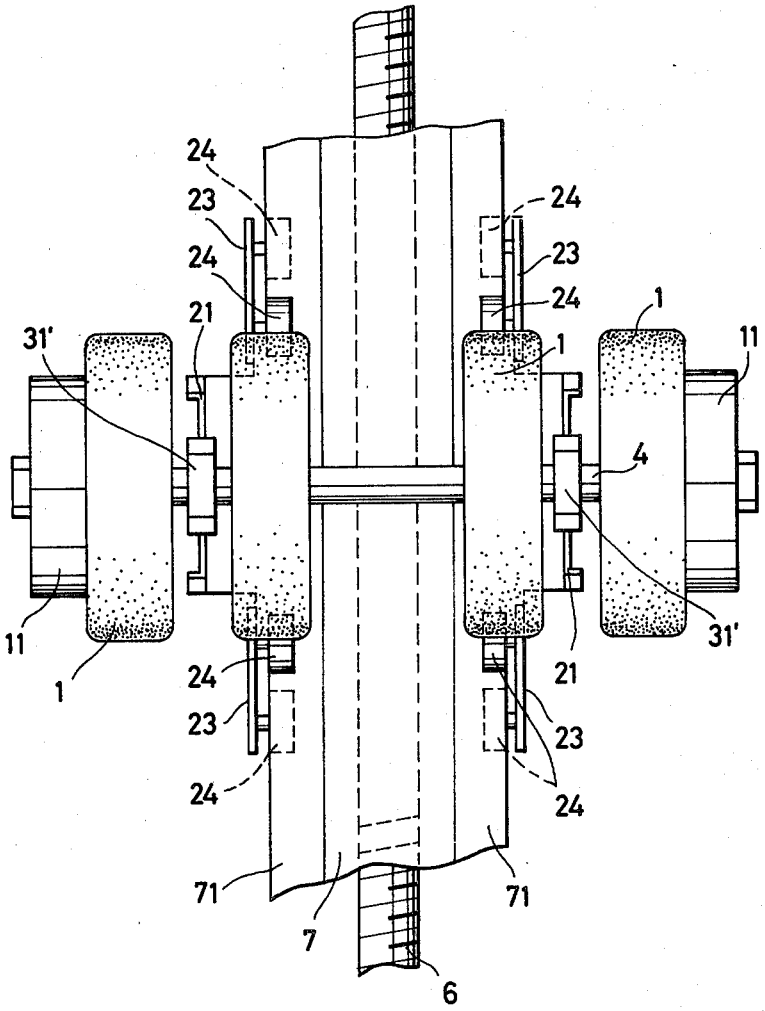
FIG. 5 is a plan view of the roller moving frame in FIG. 3.
Figure 6:
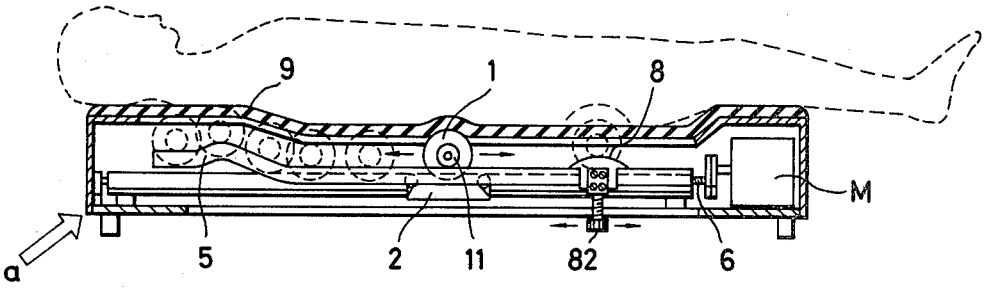
FIG. 6 is a longitudinal sectional view of a finger-pressure apparatus according to a second embodiment of the present invention.

A first embodiment of this invention will be described with reference to FIGS. 1 to 5. In the roller type finger-pressure apparatus of the invention, rollers are moved longitudinally over a finger-pressure apparatus body a similar to a bed, to perform a finger-pressure treatment. The body a is substantially in the form of a relatively flat box, and both end portions of the upper surface of the body a are at a higher level than the remaining, or middle, portion. Grooves are cut longitudinally in the middle portion of the upper surface, to allow the finger-pressure rollers 1 to move longitudinally.

A plurality of finger-pressure rollers 1 are rotatably mounted on a supporting shaft 4 which is inserted into the supporting legs 21 of an inverted-U-shaped roller moving frame 2. Guide rollers 11 and 11 are mounted on both ends of the supporting shaft 4 in such a manner that they run along guide rails 5 and 5, respectively. Vertically elongated holes 31 and 31 are formed in the supporting legs 21 so that the shaft 4 is movable in the elongated holes 22. A screw shaft 6 is driven by an electric motor M, and it is coupled to the roller moving frame 2 through a feed nut 61 which is moved along the threads of the screw shaft 6. It is desirable that the feed unit 61 is made of self-lubricating synthetic resin, so that the movement is carried out smoothly. A cover 7 having a substantially inverted-U-shaped section is provided for the screw shaft 6, so that the feed nut 61 can move along the substantially U-shaped groove of the cover 7. Rocking preventing plates 23 are formed at the four corners of the roller moving frame 2. Two guide rollers 24 and 24 arranged above and below are mounted on each rocking preventing plate 23, in such a manner that the guide rollers 24 hold from above and below the flanges 71 and 71 which extend horizontally from two lower edges of the cover 7.

As shown in FIG. 1, each of the guide rails 5 and 5 is bent obliquely upwardly near its one end, so that the configuration of the guide rails is in conformance with the curve of the back of the human body.

Guide frames 31' may optionally be inserted into the elongated holes 31 which are formed in the supporting legs 21 of the roller moving frame as described above; however, the provision of the guide frames 31' is not always necessary.

The upper surface of a finger-pressure apparatus body a is covered with a cover 9 having suitable strength and elasticity such as a sheet made of synthetic resin. The finger-pressure apparatus of the invention is preferably so designed that the direction of rotation of the motor M is changed by limit switches or the like (not shown) when the roller moving frame 2 reaches each of the two ends of the finger-pressure apparatus body a.

In operation, as the screw shaft 6 is turned, the roller moving frame 2 integral with the feed nut 61 is moved, so that the rollers 1 protruded upwardly of the apparatus body a are moved along either side of the backbone, while rotating, thus giving a finger-pressure effect thereto.

According to the invention, the cover 7 having a substantially inverted-U-shaped section is provided for the screw shaft 6. Therefore, the finger-pressure apparatus of the invention is considerably more reliable, since it is free from the problem that the rotating screw shaft 6 may contact unrelated materials and wind them in to jam the screw drive. Furthermore, since the screw shaft 6 is covered in its entirety, the apparatus is free from the problem that dust sticks to the shaft to make the movement of the feed nut 61 rough.

The cover 7 serves not only as a cover for the screw shaft 6 but also as means for smoothly moving the roller moving frame 2. More specifically, as was described above, the cover 7 has the flanges 71 at either edge, which are held by the guide rollers 24 provided at the rocking preventing plates 23 of the roller moving frame 2. Therefore, even when the roller moving frame 2 tends to tilt forwardly or backwardly by the resistance which is caused when the rollers are being moved, the roller moving frame 2 will move smoothly since it will be kept upright by the interaction of the guide rollers 24 and the flanges 71.

Furthermore, according to the invention, the vertically elongated holes 31 are formed in the supporting legs 21 of the moving frame 2, and the supporting shaft 4 of the roller 1 is loosely fitted in the elongaged holes 31. Accordingly, when the rollers 1 reach the bent portions of the guide rails 5, only the rollers 1 are raised as indicated by the dotted lines in FIG. 1 or 3 with the moving frame maintained stationary. Thus, the finger-pressure action can be effectively carried out.

In a second embodiment shown in FIGS. 6 through 12, the structure is quite similar. The finger-pressure rollers 1 are rotatably mounted on a supporting shaft 4 which is inserted into holders 3. The holders 3 are inserted into the supporting legs 21 of an inverted-U-shaped roller moving frame 2, so as to allow the vertical movement of the support shaft 4. This is in contrast to the first embodiment wherein the shaft 4 is mounted directly in the supporting legs 21. Guide rollers 11 and 11 are mounted on either end of the supporting shaft 4 in such a manner that they run along guide rails 5 and 5, respectively.

Each of the holders 3 used in this second embodiment is a vertically elongated plate along the central axis of which a vertically elongated hole 31 is formed to allow the vertical movement of the supporting shaft 4. Furthermore, slide grooves 32 and 32 are formed in both side surfaces of each holder 3, so that the holders 3 can be slidably inserted into the respective support legs 21. Each support 21 has stops 22, which will engage respective locking pawls 33 protruded sidewardly from the lower end of the holder 3, to prevent the holder from coming off the supporting leg 21. A screw shaft 6 is turned by an electric motor M. The screw shaft 6 is coupled to the roller moving frame 2 through a feed nut 61 which is moved along the threads of the screw shaft 6. The screw shaft 6 is provided with a cover 7 having a substantially inverted-U-shaped section, so that the feed nut 61 can move in the U-shaped groove of the cover 7.

In the embodiment, rocking preventing plates 23 are formed at the four corners of the roller moving frame 2. As shown most clearly in FIG. 9, the guide rollers 24 are mounted for engagement only with the top surfaces of the flanges 71 as the frame moves longitudinally, with the lower surface of flanges 71 being supported by a flange portion of a member 61*a* surrounding the feed nut 61. If preferred, the structure of FIG. 4 could be used wherein the guide rollers 24 and 24 are arranged above and below the flange 71 in such a manner that the guide rollers 24 of the rocking preventing plates 23 hold from above and below the flanges 71 and 71 which are extended from both lower edges of the cover 7.

Each of the guide rails 5 is bent obliquely upwardly near its one end as shown in FIG. 1, so that the configuration of the guide rails 5 is in conformance with the curve of the user's neck. It goes without saying that the guide rails 5 may be bent to whatever shape is desired for finger-pressure treatment.

Figure 7:
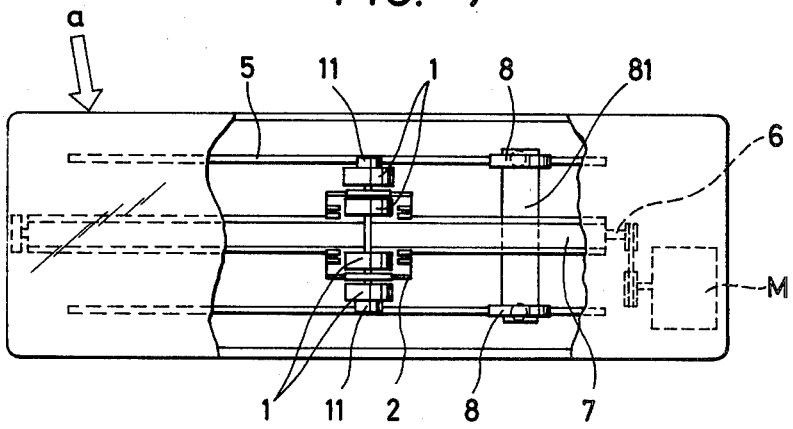
FIG. 7 is a plan view of the finger-pressure apparatus of FIG. 6 from which a part of the upper cover has been cut away.
Figure 8:
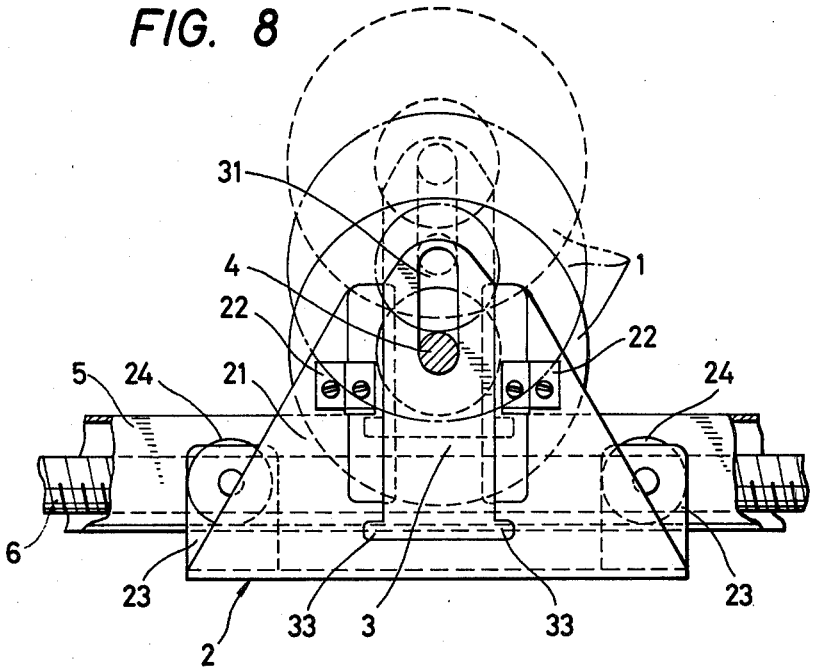
FIG. 8 is a side view of a roller moving frame of the apparatus of FIG. 6.
Figure 9:
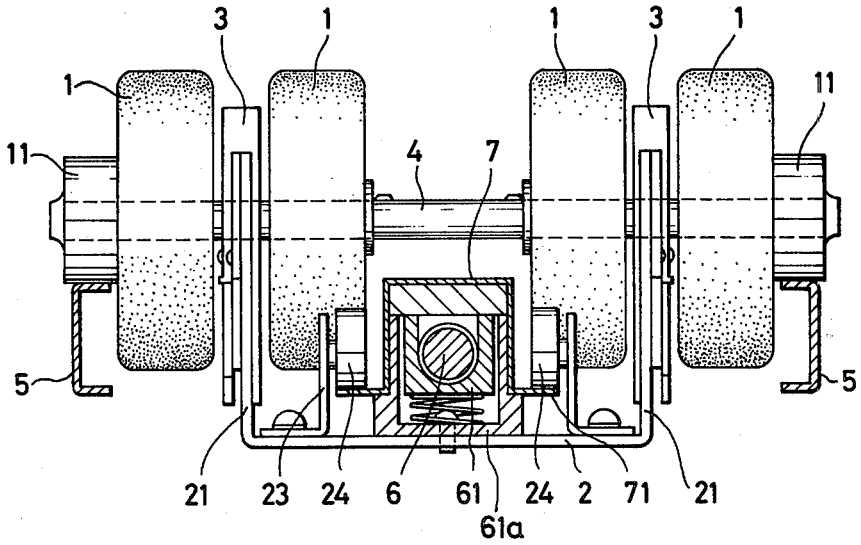
FIG. 9 is a front view of the roller moving frame shown in FIG. 8.
Figure 10:
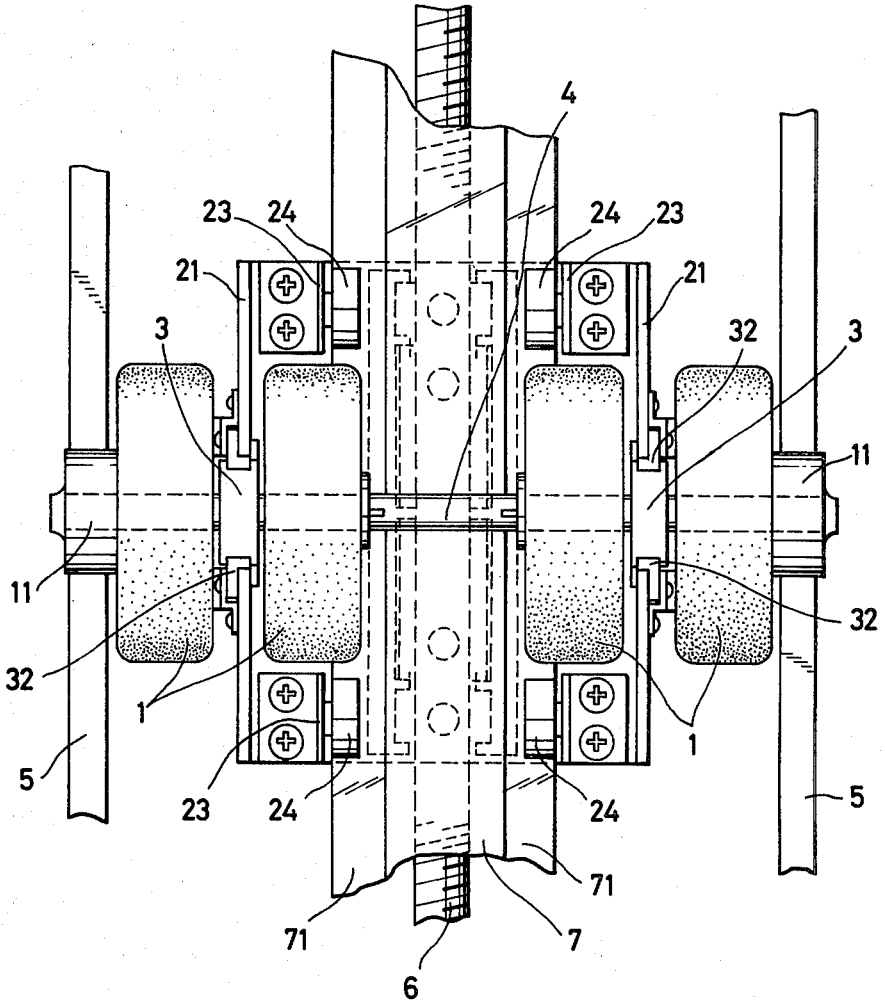
FIG. 10 is a plan view of the roller moving frame in FIG. 8.
Figure 11:
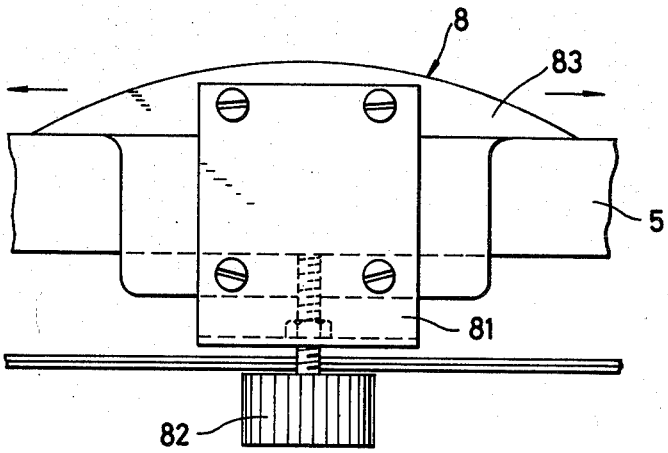
FIG. 11 is a side view of an auxiliary rail of the apparatus of FIG. 6.
Figure 12:
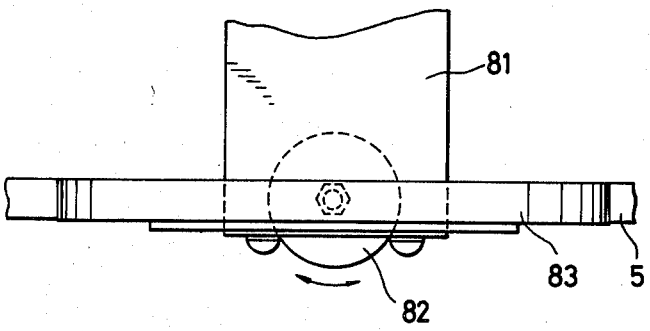
FIG. 12 is a plan view of the auxiliary rail in FIG. 11.

Auxiliary rails 8 and 8 may be provided on the guide rails 5 and 5, respectively. More specifically, as shown in FIGS. 7, 11 and 12, the auxiliary rails 8 are secured to both ends of a U-shaped base plate 81 which extends below the guide rails 5 and 5. The base plate 81 is fixed to the guide rails 5 and 5 with fixing screws 82. Each of the auxiliary rails 8 is inverted-L-shaped and has the same width as the rail 5. The upper surface of each auxiliary rail 8 is a convex surface 83. The auxiliary rail 8 is secured to the rail 4 with the convex surface 83 above the rail 5 as clearly shown in FIGS. 6 and 11.

A cover 9 is placed on the upper surface of the finger-pressure apparatus body a. The cover 9 is made of synthetic resin sheet or the like having suitable strength and elasticity. It is desirable that the apparatus is so designed that the direction of rotation of the motor M is changed by limit switches or the like (not shown) when the roller moving frame 2 reaches each of the two ends of the apparatus body a.

In operation, as the screw shaft 6 is turned, the roller moving frame 2 integral with the feed nut 61 is moved. As a result, the rollers 1 protruded from the upper surface of the apparatus body a are moved along both sides of the backbone, while rotating, so that a finger-pressure effect is given thereto.

The vertically elongated holes 31 are formed in the holders 3 which are inserted in the supporting legs 21 of the moving frame 2, and the supporting shaft 4 of the rollers 1 is loosely inserted in the elongated holes 31, as described above. Therefore, when the rollers 1 reach the bent portions of the guide rails 5, the supporting shaft 4 of the rollers 1 is moved vertically along the elongated holes 31, that is, only the rollers 1 are raised as indicated by the one-dot chain lines in FIGS. 6 or 8, thus performing a finger-pressure treatment effectively.

According to this invention, the supporting legs 21 of the moving frame 2 and the holders 3 for receiving the supporting shaft 4 of the rollers 1 are provided separately, and each holder 3 is vertically slidably inserted into the respective supporting leg 21. This is particularly effective in cases where the guide rails 5 are greatly curved or the convex surfaces 83 of the auxiliary rails 8 are very high. That is, upon arrival of the rollers 1 at such a position, the shaft 4 is raised to the upper ends of the elongated holes 31 in the holders 3 and is further raised to lift the holders 3 from the supporting legs 21, as a result of which the rollers 1 are lifted to the position indicated by the dotted lines in FIG. 8. Thus, according to the invention, the stroke of vertical movement of the rollers 1 for a finger-pressure treatment can be made much larger than that of the conventional roller type finger-pressure apparatus. Furthermore, in the case of a finger-pressure apparatus in which the vertical dimension of the supporting legs is small because it is impossible to provide a long distance between the guide rails and the box cover, the stroke of vertical movement of the rollers can be made substantially twice the vertical dimension of the supporting legs according to the invention. That is, it is possible to allow a relatively compact roller type finger-pressure apparatus to have the same finger-pressure effects as those of a relatively large roller type finger-pressure apparatus.

What is claimed is:

1. A roller-type finger pressure apparatus comprising:

an apparatus body;

two parallel guide rails extending within said body in a first direction and each formed with at least one cam portion which is at least slightly higher than the remaining portion thereof;

screw drive means including a screw shaft running between said guide rails, means for rotating said screw shaft and moveable along said shaft in response to rotation of said shaft;

roller frame means coupled to said feed element for movement therewith;

a plurality of finger-pressure rollers and shaft means for mounting said finger pressure rollers on said frame means for movement therewith in said first direction and for vertical movement with respect thereto;

cam follower means carried by said shaft means adjacent to and positioned in a substantially direct horizontal alignment with said plurality of finger-pressure rollers for contacting said guide rails and moving said finger pressure rollers vertically upon contacting said one cam portion of said guide rails;

cover means for covering a substantial portion of said screw shaft and having at least one flange extending away from said cover means in a direction perpendicular to said first direction; and engaging means secured to said frame means for engaging said flange to resist tilting of said frame means.

2. A finger-pressure apparatus as claimed in claim 1, wherein said flange extends in a substantially horizontal direction.

3. A finger-pressure apparatus as claimed in claim 1, wherein said flange includes first and second opposite surfaces and said engaging means engages both surfaces of said flange.

4. A finger-pressure apparatus as claimed in claim 3, wherein said engaging means engages said first surface at a plurality of locations.

5. A finger-pressure apparatus as claimed in claim 4, wherein said engaging means comprises a plurality of pairs of first and second guide rollers, each first roller contacting said one surface and each second roller contacting said second surface.

6. A finger-pressure apparatus as claimed in claim 5, wherein said at least one flange comprises a plurality of flanges extending from said cover means in different directions, each flange being engaged by said engaging means.

7. A roller-type finger-pressure apparatus, comprising:

a finger-pressure apparatus body;

two parallel guide rails extending with said body in a first direction and each formed with at least one portion which is at least slightly higher than a remaining portion thereof;

roller frame means movable in said first direction;

drive means for moving said frame means;

a plurality of finger-pressure rollers;

mounting means for mounting said finger-pressure rollers to said frame means for movement therewith in said first direction and for vertical movement relative thereto, said mounting means including a holder plate having a vertically elongated hole therein, shaft means passing through said rollers and vertically slidable within said hole, and slidable mounting means for slidably mounting said holder plate to said frame means; and camming means for engaging said guide rails and moving said finger-pressure rollers vertically upon engagement of said one portion.

8. A finger-pressure apparatus as claimed in claim 7, wherein said shaft means comprises a single shaft passing through a plurality of said finger pressure rollers.

9. A finger-pressure apparatus as claimed in claim 8, wherein said camming means comprises a pair of camming guide rollers mounted on said shaft at either end thereof and in contact with respective ones of said guide rails.

10. A finger-pressure apparatus as claimed in claim 8, wherein said drive means comprises a screw shaft extending between said rails, means for rotating said screw shaft and a feed element coupled to said frame and contacting said shaft for movement in said first direction with rotation of said shaft, said apparatus further comprising:

a cover disposed over a substantial portion of said screw shaft and having at least one flange extending away from said cover; and engaging means secured to said frame for engaging said flange during movement of said frame.

11. A finger-pressure apparatus as claimed in claim 10, wherein said flange extends in a substantially horizontal direction.

12. A finger-pressure apparatus as claimed in claim 10, wherein said flange includes first and second opposite surfaces and said engaging means engages both surfaces of said flange.

13. A finger-pressure apparatus as claimed in claim 12, wherein said engaging means engages said first surface at a plurality of locations.

14. A finger-pressure apparatus as claimed in claim 13, wherein said engaging means comprises a plurality of pairs of first and second guide rollers, each first roller contacting said one surface and each second roller contacting said second surface.

15. A finger-pressure apparatus as claimed in claim 14, wherein said at least one flange comprises a plurality of flanges extending from said cover means in different directions, each flange being engaged by said engaging means.

16. A finger-pressure apparatus as claimed in any one of claims 7–10, further including a pair of auxiliary rails (8) each of which is fixed to one of said guide rails at an adjustable position thereon and each of which has an upper convex surface.

17. A finger-pressure apparatus as claimed in claim 16, wherein said auxiliary rails are coupled to each other by a base plate (81).

* * * * *